US010480211B2

(12) United States Patent
Breen et al.

(10) Patent No.: US 10,480,211 B2
(45) Date of Patent: Nov. 19, 2019

(54) HANDRAIL ASSEMBLY, SYSTEM AND METHOD OF INSTALLATION

(71) Applicants: Paul Breen, Gladesville (AU); Philip Breen, Tipperary County (IE)

(72) Inventors: Paul Breen, Gladesville (AU); Philip Breen, Tipperary County (IE)

(73) Assignee: NONDRILL PTY LTD, New South Wales (AU)

( * ) Notice: Subject to any disclaimer, the term of this patent is extended or adjusted under 35 U.S.C. 154(b) by 427 days.

(21) Appl. No.: 15/102,163

(22) PCT Filed: Dec. 3, 2014

(86) PCT No.: PCT/AU2014/050396
§ 371 (c)(1),
(2) Date: Jun. 6, 2016

(87) PCT Pub. No.: WO2015/081387
PCT Pub. Date: Jun. 11, 2015

(65) Prior Publication Data

US 2016/0312491 A1 Oct. 27, 2016

(30) Foreign Application Priority Data

Dec. 4, 2013 (AU) ..... 2013904713

(51) Int. Cl.
*E04B 1/41* (2006.01)
*E04H 17/22* (2006.01)
(Continued)

(52) U.S. Cl.
CPC ..... *E04H 17/22* (2013.01); *E04B 1/41* (2013.01); *E04F 11/1804* (2013.01);
(Continued)

(58) Field of Classification Search
CPC . E04H 12/2253; E04H 12/22; E04H 12/2269; E04H 17/22; E04F 11/1834; E04F 11/1804; E04F 11/1812
See application file for complete search history.

(56) References Cited

U.S. PATENT DOCUMENTS 3,225,501 A * 12/1965 McCaron ..... E01F 15/06 52/298
3,652,118 A 3/1972 Goldverg
(Continued)

FOREIGN PATENT DOCUMENTS

CN 202882454 U 4/2013
DE 8114740 U1 * 1/1982
(Continued)

*Primary Examiner* — Jonathan P Masinick
(74) *Attorney, Agent, or Firm* — Leason Ellis LLP

(57) ABSTRACT

A handrail includes a support assembly for attachment to a concrete slab having an upper surface with attachment formations anchored at the upper surface. The assembly includes a handrail support component and a connector component. The connector component is attachable to the support component and an attachment formation. The support and connector components can be tightened to each other to tighten the connector component to the attachment formation for tightening the support component onto the slab. The invention extends to a handrail system including the slab, and to a method of installing handrail components on the slab.

16 Claims, 3 Drawing Sheets

(51) Int. Cl.

| | |
|---|---|
| ***E04H 12/22*** | (2006.01) |
| ***E04G 21/14*** | (2006.01) |
| ***E04G 21/32*** | (2006.01) |
| ***E04F 11/18*** | (2006.01) |

(52) U.S. Cl.
CPC ..... *E04F 11/1812* (2013.01); *E04F 11/1834* (2013.01); *E04G 21/142* (2013.01); *E04G 21/3219* (2013.01); *E04H 12/22* (2013.01); *E04H 12/2253* (2013.01)

(56) References Cited

U.S. PATENT DOCUMENTS

| | | | | |
|---|---|---|---|---|
| 6,547,223 | B1 | 4/2003 | Letourneau | |
| 7,055,807 | B2 * | 6/2006 | Pesta | E04H 12/2269 160/351 |
| 7,513,083 | B2 * | 4/2009 | Pryor | E02D 27/42 403/232.1 |
| 8,365,485 | B2 * | 2/2013 | Reyneveld | E04H 12/2269 52/295 |
| 8,827,037 | B2 * | 9/2014 | Chilton | E04G 5/14 182/113 |
| 2008/0179477 | A1 * | 7/2008 | Harney | E04G 5/04 248/238 |

FOREIGN PATENT DOCUMENTS

| | | | |
|---|---|---|---|
| DE | 19653985 | A1 | 6/1998 |
| EP | 1686233 | A2 | 8/2006 |
| EP | 1978182 | A1 | 8/2017 |
| FR | 2871827 | A1 | 11/2008 |
| GB | 1138339 | A | 1/1969 |
| JP | S53153331 | U | 12/1978 |
| JP | 2010-048040 | * | 3/2010 |
| JP | 2017-172233 | * | 9/2017 |

* cited by examiner

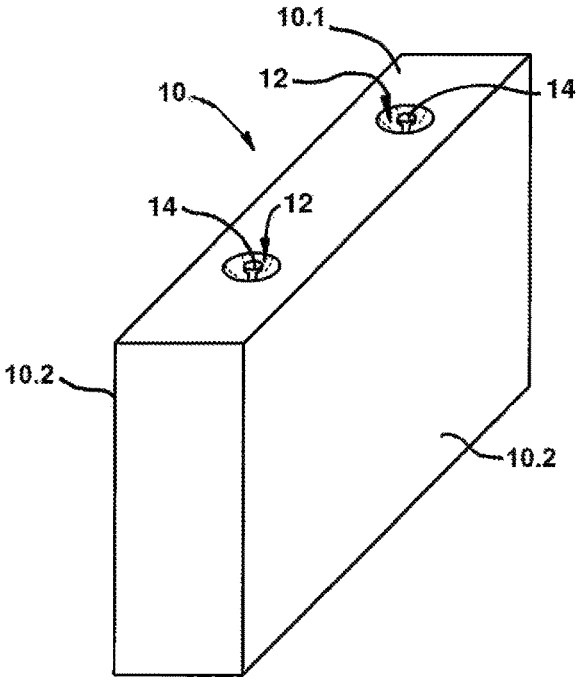
Fig. 1
Fig. 2
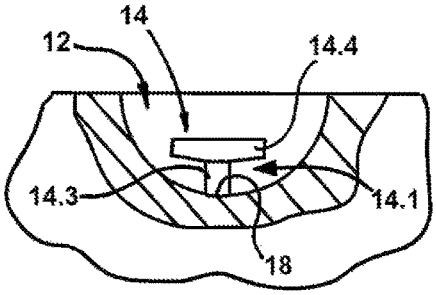
Fig. 3
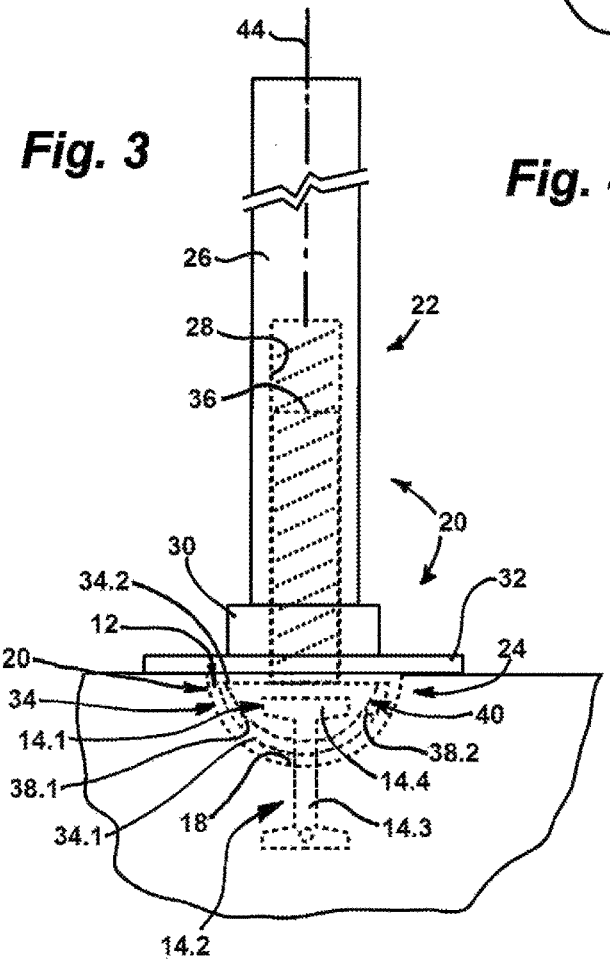
Fig. 4
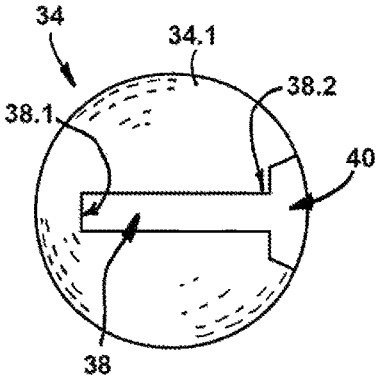

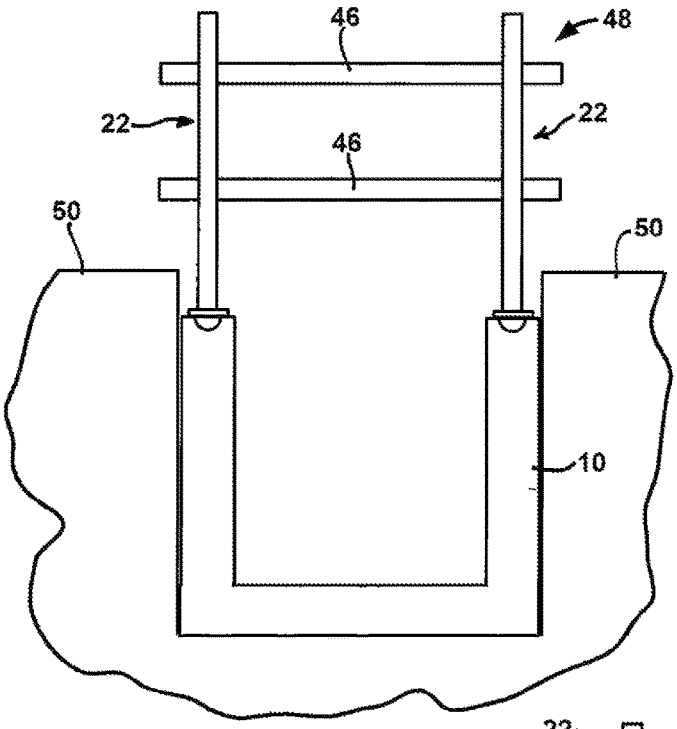
Fig. 6
Fig. 7
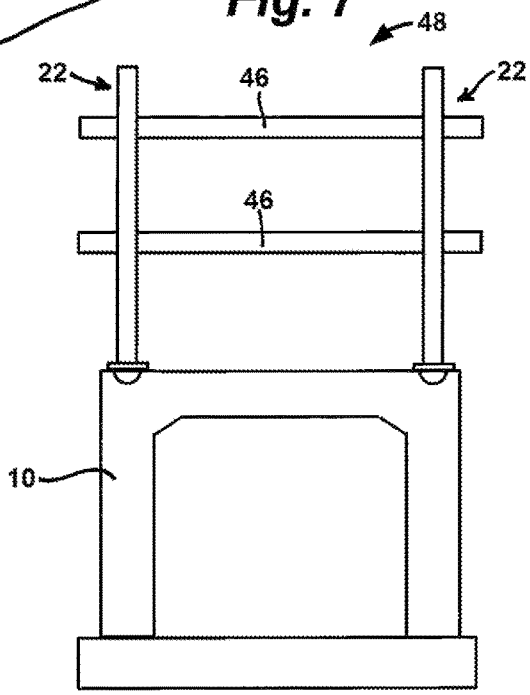
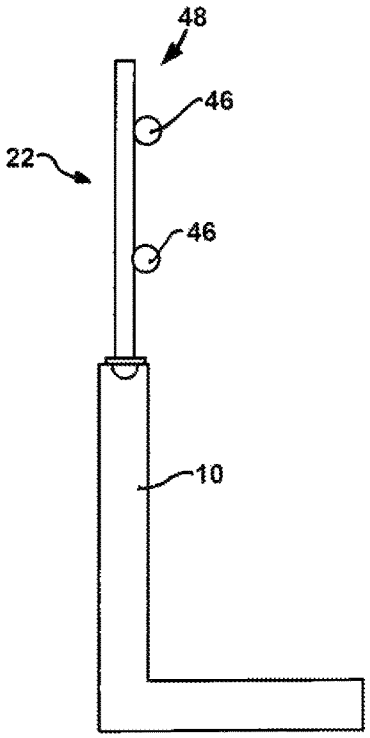
Fig. 8

HANDRAIL ASSEMBLY, SYSTEM AND METHOD OF INSTALLATION

CROSS-REFERENCE TO RELATED APPLICATIONS

This application is a U.S. National Stage Application under 35 U.S.C. § 371 of International Patent Application No. PCT/AU2014/050396, filed Dec. 3, 2014 which claims priority to Australia Application No. 2013904713, filed Dec. 4, 2013, each of which is hereby incorporated by reference as if set forth in their respective entireties.

FIELD OF THE INVENTION

This invention relates to a handrail system and a handrail support assembly for installation on a concrete slab, and to a method of installing handrail components on a concrete slab.

BACKGROUND TO THE INVENTION

In the construction industry, it is frequently necessary to construct handrails on the tops of platforms to reduce of risk of workers falling from the platforms, the handrails thereby facilitating the safety of the workers.

A common example of this relates to the use of such platforms in the form of concrete wall panels (slabs). These are used, for example, to shore up road-side trenches or other ground cavities. The panels often have upper extremities at raised elevations, and this can give rise to hazardous situations where workers are required to walk along the tops of the panels.

A known method of constructing handrails for such panels involves the use of welded frames with portions that rest on top of the panels, handrail posts extending upwards from those portions, and legs extending downwards from those portions on the two opposite sides of the panels. The legs serve to retain the handrails in place on the panels, and to keep the posts in substantially upright positions.

However, it is often necessary to build up ground-fill and concrete on at least one side of such panels. Such concrete can foul and damage the legs, and prevent them from being removed, when such removal is desired.

A known method of attempting to avoid this is to insert a barrier or substance such as foam against the wall and legs of the handrail to act as a liner to separate the ground-fill or concrete from the wall. This is to allow the handrail to be removed even after such ground-fill or concrete has set.

However, the legs, when removed, leave voids and these need to be filled, for example, with grout. This is labour intensive, time-consuming and hence also costly in terms of man-hours.

In addition, sometimes, the foam does not adequately protect the legs and these become jammed by the set concrete, thereby necessitating cutting off of the legs in order to remove the handrails. Again, this can contribute to inconvenience and cost.

A method that has been used to attach handrails to such slabs is to drill holes in the slabs and attach anchor bolts to the slabs for attachment of handrail supports. However, a problem with this method is that often, the holes are drilled immediately above reinforcing steel which has been cast into the slabs when they are formed, as such steel cannot be seen when commencing the drilling.

The depth to which the holes need to be drilled is typically greater than the depth at which the reinforcing steel is embedded in the concrete. Therefore, such holes are usually not suitable for their purpose, and other holes need to be drilled instead. Often, a number of unusable holes are drilled during this process.

Apart from the fact that this is labour-intensive, time-consuming and costly, when drilling such unusable holes, the drills often connect with the reinforcing steel, thus causing it to be exposed to the environment. In order to protect the integrity of the steel, the holes need to be suitably sealed. This, in turn, involves further labour, time and cost.

In addition, often the sealing is not effective, with the result that the reinforcing steel is exposed to the environment. This, in turn, can result in moisture penetrating the slabs, causing rusting of the steel, and concrete cancer, thereby significantly reducing the useable lifespan of the slabs.

It is an object of the present invention to ameliorate or overcome the disadvantages of the prior art or to provide a useful alternative thereto.

SUMMARY OF THE INVENTION

According to a first aspect of the invention, there is provided a handrail support assembly adapted for attachment to a solid slab having an upper surface, with an attachment formation being anchored to the slab at or adjacent to the upper surface, the support assembly including:

- a handrail support component; and
- a connector component adapted to be attached to the support component and detachably connected to the attachment formation,
- wherein the support component and connector component are adapted to be tightened to each other such that the connector component is tightened to the attachment formation whereby the support component is tightened into fixed engagement with the slab.

According to a second aspect of the invention there is provided a handrail system including:

- a solid slab having an upper surface, with an attachment formation being anchored to the slab at or adjacent to the upper surface; and
- a handrail support assembly according to the first aspect of the invention, adapted for attachment to the slab.

In a preferred embodiment, there is included a recess in the upper surface, the attachment formation being disposed within the recess.

In a preferred embodiment, the connector component is adapted for hooking onto the attachment formation. In another preferred embodiment, the connector component is adapted for the attachment formation to hook onto the connector component.

In a preferred embodiment, the attachment formation is in the form of a lug.

In a preferred embodiment, the lug includes a stem portion and a shoulder portion which is broader than the stem portion, and the connector component has a locking formation which includes a slot for receiving the stem portion therealong such that the locking formation is adapted to be retained by the shoulder portion.

Preferably, the slot extends along a curved path such that the connector component is attachable to the lug by rotation of the connector component relative to the lug.

In a preferred embodiment, the connector component includes a threaded anchor portion and the support component includes a complementary threaded support portion, wherein the connector component and support component are configured to be attached to each other by said threaded portions.

Preferably, the handrail support assembly is adapted for the connector component to be tightened in relation to the attachment formation on relative rotation of the threaded anchor portion and threaded support portion.

Preferably, the anchor portion is in the form of a cylindrical rod and the support portion is in the form of a cavity defined by the support component, for receiving the rod.

In a preferred embodiment, the support component includes at least one laterally extending brace configured to engage with the upper surface of the slab when the support component is tightened in engagement with the slab.

Preferably, the brace is in the form of a plate formation.

According to a third aspect of the invention, there is provided a method of installing handrail components on a solid slab having an upper surface and a plurality of attachment formations anchored to the slab at or adjacent to the upper surface, the method including:

- providing a plurality of handrail support assemblies according to the first aspect of the invention or preferred embodiments thereof;
- detachably connecting the connector components to respective attachment formations; and
- tightening the support component and connector component of each assembly to each other such that the respective connector component is tightened to the respective attachment formation whereby the respective support component is tightened into fixed engagement with the slab.

In a preferred embodiment, the method includes casting the slab with the attachment formations anchored thereto.

In a preferred embodiment, the method includes attaching a handrail to the handrail support components.

In a preferred embodiment, the slab is a concrete slab.

In a preferred embodiment, the or each attachment formation is within lateral bounds of the upper surface.

BRIEF DESCRIPTION OF THE DRAWINGS

Preferred embodiments of the invention will now be described, by way of example only, with reference to the accompanying drawings in which:

FIG. 1 is a schematic perspective view of a precast concrete slab with lifting lugs anchored to it;

FIG. 2 is a schematic front view, partly cut away, of a portion of the slab of FIG. 1, showing a recess therein and a lifting lug in the recess;

FIG. 3 is a schematic front view of a part of the wall of FIG. 1 with a handrail support assembly according to an embodiment of the invention mounted thereon and attached to a lug according to FIG. 1;

FIG. 4 is a schematic bottom view of a locking portion of the assembly of FIG. 3;

FIG. 6 is a schematic front view of a road-side tank or pit with handrail assemblies of FIG. 3 installed thereon;

FIG. 7 is a schematic front view of a culvert with handrail assemblies of FIG. 3 installed thereon; and FIG. 8 is a schematic end view of a concrete wall with the handrail assembly of FIG. 3 installed thereon.

DETAILED DESCRIPTION

Figure 5:
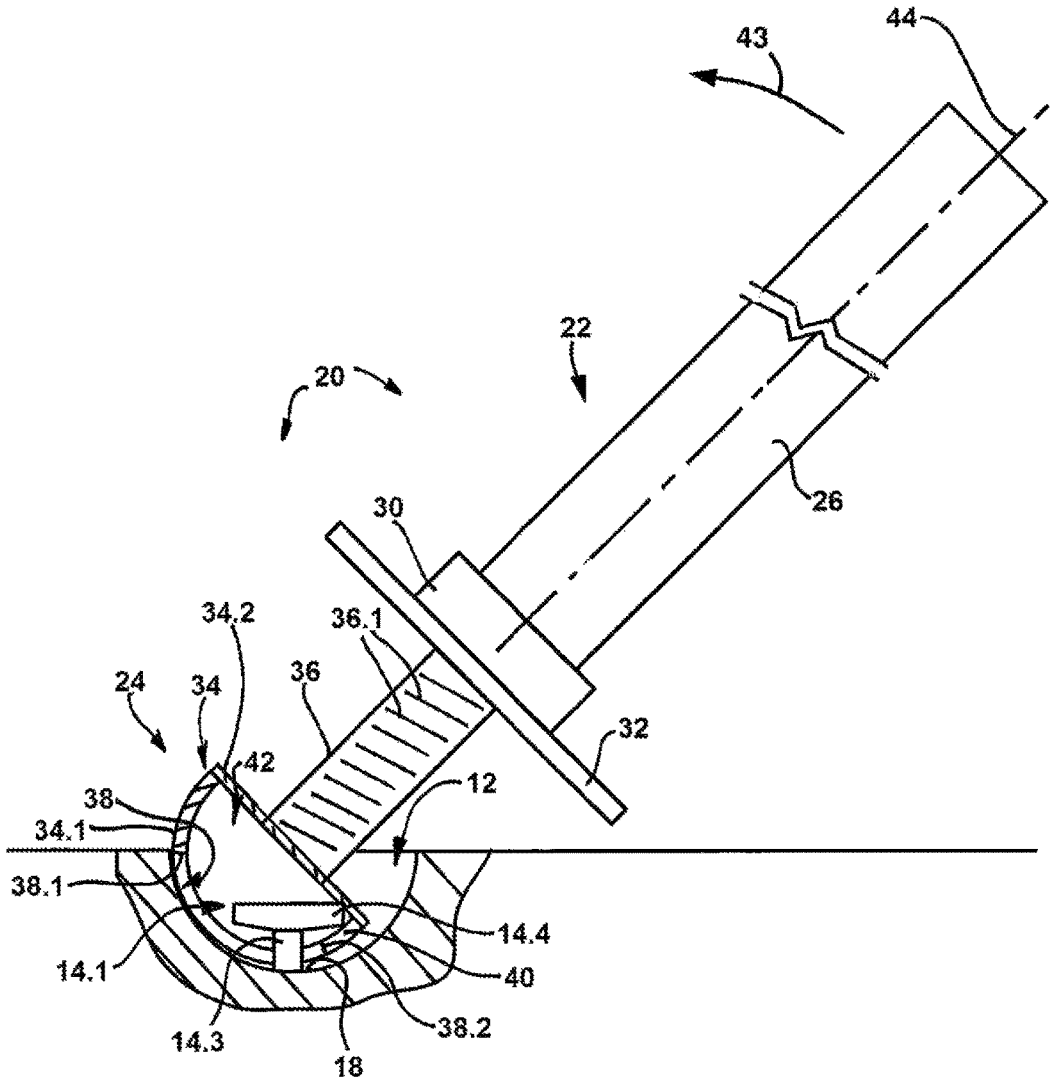
FIG. 5 is a schematic front view of the handrail support assembly of FIG. 3 in the process of being installed on the slab.

This invention relates to the attachment of supports for handrails on concrete slabs, for example of the type used for road-side construction. However, it is not limited to concrete slabs for such use.

According to a preferred embodiment, this invention is envisaged for use with precast concrete slabs as exemplified by the slab 10 in FIG. 1. which is in the form of a concrete panel. Such panels 10 are typically formed with recesses 12 in one of their surfaces, such as an upper edge surface 10.1. The recesses 12 are typically of part-spherical shape. In addition, such slabs are typically provided with attachment elements 14 having upper portions 14.1 in the form of lifting lugs protruding from the lowermost extremities 18 of the recesses, and lower portions 14.2 embedded in the slab 10 to anchor the attachment elements to the slab (see FIG. 3).

The lugs 14.1 typically do not protrude beyond the plane of the surface 10.1 in which the recesses 14 are formed.

In addition, the lugs 14.1 are within the lateral bounds of the panel 10 in that they do not extend beyond the planes of the two opposite side walls 10.2 of the panel 10.

Each attachment element 14, and hence each lug 14.1, includes a narrow stem portion 14.3 and upper shoulder portion 14.4, with the shoulder upper portion being broader than the stem portion.

While these lugs 14.1 are intended for use with lifting equipment (not shown) for lifting the panels 10, they can also be used for the present invention according to a preferred embodiment, as described in more detail below.

Referring to FIG. 3, there is shown a handrail support assembly 20. The assembly 20 includes a support component 22 which is assembled to a connector component 24.

The support component 22 includes a rod 26 having an internal cavity 28, an internally threaded nut 30 fixed to a lower end of the rod, and a plate 32 fixed to the opposite, lower side of the nut.

The plate 32 extends well beyond the lateral outer extremities of the rod 26 and nut 30.

The connector component 24 includes a locking portion 34 and an anchor portion in the form of a rod 36 which is joined integrally to the locking portion. Accordingly, the anchor portion 36 is referred to below as an anchor rod.

The locking portion 34 includes a first wall 34.1 of part-spherical shape. Accordingly, the first wall is referred below as a curved wall. The curved wall 34.1 defines a slot 38. As the slot 38 is formed in the curved wall 34.1, it extends along a curved path which is also part-spherical.

As best seen in FIG. 4, one end 38.1 of the slot 38 is closed, while the other end 38.2 of the slot opens into a broad aperture 40.

The curved wall 34.1 is joined to a second, flat, upper wall 34.2, so that the curved and upper walls define an interior space 42 of the locking portion 34. Thus, the locking portion 34 is substantially hollow.

The anchor rod 36 is joined to the upper wall 34.2 and has an outer screw thread 36.1. The thread 36.1 is complementary to the thread of the nut 30.

When the support component 22 is in the in-use position as illustrated in FIG. 3, the anchor rod 36 extends though the plate 32 and nut 30, and into the cavity 28.

The manner of erecting the support assembly 20 into the position as shown in FIG. 3 is described below.

In order to install the support assembly 20, the support component 22 is positioned relative to the connector component 24 such that the anchor rod 36 is only partly screwed into the cavity 28 as shown in FIG. 5. In this configuration, as seen, the locking portion 34 is spaced apart from the plate 32.

To engage the locking portion 34 with the lug 14.1, the support assembly 20 is orientated at an acute angle to the vertical as illustrated in FIG. 5. Because of the distance between the plate 32 and the locking portion 34, there is sufficient space for the support assembly 20 to be orientated in this manner without the plate being impeded by the upper surface 10.1 of the slab 10.

The support assembly 20 is partially disposed in the recess 12 and moved relative to the lug 14.1 such that the shoulder portion 14.4 of the lug is received through the aperture 40.

Once the shoulder portion 14.4 has passed through the aperture 40, the stem portion 14.3 can be slid along the slot 38. This can be achieved by rotating the support assembly 20 from the acute angle shown in FIG. 5 in the direction of the arrow 43, so as to orientate it substantially vertically as shown in FIG. 3. It will be appreciated that the locking portion 34 constitutes a hook formation which in effect hooks onto the lug 14.1.

Once the support assembly 20 is vertically positioned, the support component 22 can be rotated relative to the connector component 24, about a longitudinal axis 44 of the support, such that the nut 30 rotates relative to the anchor rod 36.

As this is done, the screw thread 36.1 of the anchor rod 36 and the screw thread of the nut 30 rotate relative to each other so that the support component 22 is tightened onto the connector component 24.

With sufficient tightening, the support component 22 moves downward relative to the connector component 24 until the plate 32 is firmly seated and tightened on the surface 10.1 of the slab 10.

In this position, the connector component 24 pulls upward on the lug 14.1, so that the lug firmly retains the support assembly 20.

Although the shoulder portion 14.4 of the lug 14.1 is not shown in contact with the curved wall 34.1 of the connector component 24 in FIG. 3, in use, in order for the connector component to pull upwards on the lug, and for the lug thereby to firmly retain the connector component, the curved wall needs to be in contact with the shoulder portion in order for the lug to exert a retaining force on the connector.

The plate 32 assists in preventing lateral rotational movement of the support component 22 (i.e. movement away from a vertical orientation) due to the plate being braced against the surface 10.1 of the slab 10.

The same procedure can be used to install similar support assemblies 20 at numerous similar recesses 14 and lugs 14.1 on the panel 10.

Rails, which may extend horizontally such as the rails 46, can be fixed to the to the support components 22 as shown in FIGS. 6, 7 and 8 to complete the construction of handrails 48. For this purpose, suitable connectors (not shown) can be used, such as clips, nuts and bolts, or even welding where the handrails are to be installed on a permanent basis.

In FIG. 6, a different form of slab 10 to that shown in FIG. 1 is illustrated, which is in the form of a tank or pit, and which is positioned in the surface of a road 50. The level of the road 50 relative to the slab 10 can be seen.

In FIG. 7, a different form of slab 10 to that shown in FIG. 1 is illustrated, which is in the form of a culvert, while in FIG. 8 the slab is in the form of a concrete wall.

While the description above relates to the installation of the handrail assembly 20 on a concrete slab such as the precast panel 10, embodiments of the invention also include forming such a precast slab or similar slab. For the purpose of the description below, similar reference numerals as used in relation to FIGS. 1 and 2 are used.

In particular, according to such embodiments, the slab 10 is cast with the lower portions 14.2 of the attachment elements 14 embedded at suitable positions, within recesses 12.

While the lugs 14.1 in the panel 10 shown in FIG. 1 are positioned for the purpose of lifting the panel in an even manner, where the lugs are provided specifically for the purpose of securing handrails 48, the positioning need not be suitable for lifting purposes, but can rather be determined based on the desired position of the handrails.

When the slabs 10 are cast, a suitably shaped forming component (not shown) can be used to form the recesses 12 having the desired part-spherical shape or a similar shape.

It will be appreciated that the invention as described above can be used for installing handrails 48 on a permanent or temporary basis. In particular, where used on a temporary basis, the manner of securing the support assemblies 20 to the lugs 14.1 and hence to the slab 10 enables them to be easily removed by performing, in reverse, the above method of installing the assemblies.

In addition, the invention can assist in avoiding the need to drill holes for bolts for securing handrails.

The fact that the lugs 14.1 are located within the lateral bounds of the slab 10 as described above means that the handrails 48 themselves can also be within those bounds. Thus, filling material, including concrete, can be built up or poured immediately adjacent to, and in contact with, the slabs 10 without fouling the handrails 48.

Although the invention is described above in relation to preferred embodiments, it will be appreciated by those skilled in the art that it is not limited to those embodiments, but may be embodied in many other forms.

For example, while the attachment formation is described above as being in the form of a lug 14.1, and the locking portion 34 is described as being suitable for hooking onto the lug, these components may be in other forms instead. For instance, the attachment formation may have a suitable formation other than that described above, such as an eye, recess, opening, or projection, into or onto which the locking portion 34 can hook.

Alternatively, these components may be configured for the attachment formation to hook onto the locking portion.

The invention claimed is:

1. A handrail support assembly adapted for attachment to a construction element, the element including a pre-cast concrete wall slab in the form of a rectangular cuboid having a front face and an opposite rear face, and having a vertical operational orientation in which said front and rear faces extend upwardly, the slab further having, when in the operational orientation, an upper edge and an opposite lower edge, and two opposite side edges, each of the upper, lower and side edges extending between the front face and rear face, the construction element further including a securing element having a connection portion exposed relative to the slab and an anchor portion pre-cast with, and embedded in, the slab and formed so as to engage the slab whereby the securing element is adapted for lifting of the construction element by a lifting apparatus when the lifting apparatus is attached to the connection portion, the support assembly comprising:

a handrail support having first engagement means; and a securing element connector having a first portion adapted for interlocking detachable connection to the connection portion and a second portion having second engagement means and being adapted for attachment to the handrail support, wherein the handrail support and second portion are adapted to be tightened to each other by inter-engagement of the first engagement means and second engagement means, such that the handrail support is tightened into fixed engagement with the slab, wherein the handrail support assembly has at least one outer surface which is adapted to conceal the first engagement means and second engagement means when the handrail support and second portion are tightened to each other.

2. The handrail support assembly according to claim 1, adapted for attachment to the construction element wherein the front face extends in a first plane and the rear face extends in a second plane parallel to, and spaced from, the first plane, wherein the securing element is located between the first and second planes.

3. The handrail support assembly according to claim 1, adapted for attachment to the construction element, wherein the slab defines a recess, the securing element being disposed within the recess.

4. The handrail support assembly according to claim 1, adapted for attachment to the construction element, wherein the connection portion of the securing element and the first portion of the securing element connector are adapted for hooking engagement with each other.

5. The handrail support assembly according to claim 1, adapted for attachment to the construction element, wherein the connection portion of the securing element is in the form of a lug.

6. The handrail support assembly according to claim 5, adapted for attachment to the construction element, wherein the connection portion includes a stem portion and a shoulder portion which is broader than the stem portion, and the first portion of the securing element connector includes a slot for receiving the stem portion therealong such that the first portion is adapted to be retained by the shoulder portion.

7. The handrail support assembly according to claim 6, adapted for attachment to the construction element, wherein the slot extends along a curved path such that the securing element connector is attachable to the securing element by rotation of the securing element connector relative to the slab.

8. The handrail support assembly according to claim 1, adapted for attachment to the construction element, wherein the second portion of the securing element connector includes a threaded rod and the handrail support includes a complementary threaded cavity adapted to receive the rod, wherein the securing element connector and handrail support are configured to be attached to each other by said threaded portions.

9. The handrail support assembly according to claim 8, adapted for attachment to the construction element, and for the securing element connector to be tightened in relation to the securing element on relative rotation of the threaded rod and threaded cavity.

10. The handrail support assembly according to claim 1, adapted for attachment to the construction element, wherein the handrail support includes at least one laterally extending brace configured to engage with the upper surface of the slab when the handrail support is tightened into fixed engagement with the slab.

11. The handrail support assembly according to claim 10 wherein the brace is in the form of a plate formation.

12. A handrail system, comprising a construction element and a handrail support assembly, wherein:

the construction element includes a pre-cast wall slab in the form of a rectangular cuboid having a front face and an opposite rear face, and having a vertical operational orientation in which said front and rear faces extend upwardly, the slab further having, when in the operational orientation, an upper edge and an opposite lower edge, and two opposite side edges, each of the upper, lower and side edges extending between the front face and rear face, the construction element further including a securing element having a connection portion exposed relative to the slab and an anchor portion pre-cast with, and embedded in, the slab and formed so as to engage the slab whereby the securing element is adapted for lifting of the construction element by a lifting apparatus when the lifting apparatus is attached to the connection portion;

and wherein the handrail support assembly includes a handrail support having first engagement means; and a securing element connector having a first portion adapted for interlocking detachable connection to the connection portion, and a second portion having second engagement means, the second portion being adapted for attachment to the handrail support, wherein the handrail support and second portion are adapted to be tightened to each other by inter-engagement of the first engagement means and second engagement means, such that the handrail support is tightened into fixed engagement with the slab, and wherein the handrail support assembly has at least one outer surface which is adapted to conceal the first engagement means and second engagement means when the handrail support and second portion are tightened to each other.

13. The handrail system according to claim 12 wherein the slab is a concrete slab.

14. The handrail system according to claim 12, wherein the front face extends in a first plane and the rear face extends in a second plane parallel to, and spaced from, the first plane, wherein the securing element is located between the first and second planes.

15. A method of retrofitting handrail components on a construction element, the element including a pre-cast concrete wall slab in the form of a rectangular cuboid having a front face and an opposite rear face, and having a vertical operational orientation in which said front and rear faces extend upwardly, the slab further having, when in the operational orientation, an upper edge and an opposite lower edge, and two opposite side edges, each of the upper, lower and side edges extending between the front face and rear face, the construction element further including a securing element having a connection portion exposed relative to the slab and an anchor portion pre-cast with, and embedded in, the slab and formed so as to engage the slab whereby the securing element is adapted for lifting of the construction element by a lifting apparatus when the lifting apparatus is attached to the connection portion, the method comprising:

providing a handrail support assembly having at least one outer surface, the handrail support assembly including a handrail support with first engagement means, and a securing element connector having a first portion adapted for interlocking detachable connection to the connection portion, and a second portion with second engagement means, the second portion being adapted for attachment to the handrail support;

detachably connecting the handrail support to said second portion; and tightening the handrail support and second portion to each other by inter-engagement of the first engagement means and second engagement means such that the handrail support is tightened into fixed engagement with the slab, wherein said at least one outer surface is adapted to conceal the first engagement means and second engagement means once the handrail support and second portion are tightened to each other.

16. The method of claim 15, further comprising attaching a handrail to the handrail support.

* * * * *